US011274398B2

(12) United States Patent
Yoshida

(10) Patent No.: US 11,274,398 B2
(45) Date of Patent: Mar. 15, 2022

(54) TISSUE PAPER

(71) Applicant: Daio Paper Corporation, Ehime (JP)

(72) Inventor: Shohei Yoshida, Shizuoka (JP)

(73) Assignee: Daio Paper Corporation, Ehime (JP)

( * ) Notice: Subject to any disclaimer, the term of this patent is extended or adjusted under 35 U.S.C. 154(b) by 0 days.

(21) Appl. No.: 16/976,120

(22) PCT Filed: Feb. 20, 2019

(86) PCT No.: PCT/JP2019/006280
§ 371 (c)(1),
(2) Date: Aug. 27, 2020

(87) PCT Pub. No.: WO2019/167746
PCT Pub. Date: Sep. 6, 2019

(65) Prior Publication Data

US 2021/0040695 A1 Feb. 11, 2021

(30) Foreign Application Priority Data

Feb. 28, 2018 (JP) ..... JP2018-035817

(51) Int. Cl.
*D21H 27/00* (2006.01)
*A47K 10/16* (2006.01)
(Continued)

(52) U.S. Cl.
CPC ..... *D21H 27/005* (2013.01); *A47K 10/16* (2013.01); *D21H 17/06* (2013.01); *D21H 21/24* (2013.01)

(58) Field of Classification Search
CPC .... D21H 27/005; D21H 27/002; D21H 27/00; D21H 17/06; D21H 21/24; A47K 7/00; A47K 10/16
See application file for complete search history.

(56) References Cited

U.S. PATENT DOCUMENTS 5,474,689 A * 12/1995 Laughlin ..... C11D 1/62 162/158
5,575,891 A * 11/1996 Trokhan ..... D21H 21/22 162/111
(Continued)

FOREIGN PATENT DOCUMENTS

CN 107532389 A 1/2018
EP 3760088 A1 * 1/2021 ..... D21H 17/06
(Continued)

OTHER PUBLICATIONS

Machine Translation of WO 2011080939 A1. (Year: 2011).*
International Search Report for corresponding PCT/JP2019/006280 dated Apr. 11, 2019; 3 pp.

*Primary Examiner* — Jose A Fortuna
(74) *Attorney, Agent, or Firm* — Renner, Kenner; Arthur M. Reginelli

(57) ABSTRACT

In various embodiments, the present invention provides a moisturizing tissue containing a polyol that has excellent strength while still providing a moist feeling and smoothness peculiar to the moisturizing tissue. The tissue paper has a basis weight of 15.6 to 19.1 g/m$^2$, a paper thickness of 115 to 150 μm, a content of the polyol of 17.0 to 22.0 % by mass, a moisture content of 10% by mass or more, a dry tensile strength of 310 to 410 cN/25 mm in a longitudinal direction, a dry tensile strength of 120 to 160 cN/25 mm in a lateral direction, a wet tensile strength of 55 to 90 cN/25 mm in the lateral direction, and compression energy WC of 5.0 to 6.5 gf·cm/cm$^2$ under a load of 50 g/cm$^2$ using a KES test method.

3 Claims, 1 Drawing Sheet

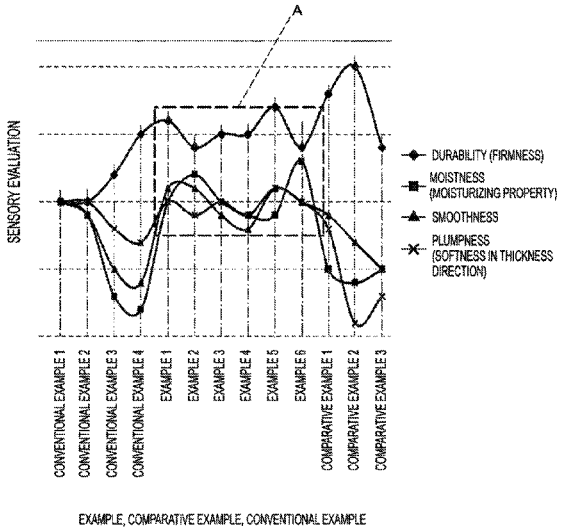

(51) Int. Cl.
*D21H 17/06* (2006.01)
*D21H 21/24* (2006.01)

(56) References Cited

U.S. PATENT DOCUMENTS 5,624,532 A * 4/1997 Trokhan ..... D21H 23/26 162/111
5,981,044 A * 11/1999 Phan ..... D21H 17/06 162/127
6,949,167 B2 * 9/2005 Shannon ..... D21H 21/16 162/109
11,001,032 B2 * 5/2021 Vogt ..... D21H 27/002
11,076,726 B2 * 8/2021 Vogt ..... B32B 7/08
2007/0137808 A1 * 6/2007 Lostocco ..... B32B 29/005 162/109
2010/0051217 A1 * 3/2010 Allen ..... D21G 1/00 162/116
2016/0289897 A1 * 10/2016 Ramaratnam ..... D21H 21/18
2017/0260696 A1 * 9/2017 Chou ..... D21H 27/40
2018/0146834 A1 5/2018 Izumi et al.
2019/0078262 A1 * 3/2019 Vogt ..... D21H 27/002
2021/0040695 A1 * 2/2021 Yoshida ..... D21H 27/005
2021/0238808 A1 * 8/2021 Tirimacco ..... D21H 27/32

FOREIGN PATENT DOCUMENTS

JP 2004-209150 A 7/2004
JP 2004209150 A * 7/2004
JP 2009-035833 A 2/2009
JP 2011152403 A * 8/2011 ..... A61K 8/0208
JP 2013-202346 A 10/2013
JP 2013202346 A * 10/2013
JP 5859593 B 2/2016
JP 2017-176761 A 10/2017
JP 2017176761 A * 10/2017 ..... D21H 27/00
WO 2011080939 A1 7/2011
WO WO-2017168931 A1 * 10/2017 ..... D21H 23/50
WO WO-2017209739 A1 * 12/2017 ..... D21H 21/20

* cited by examiner

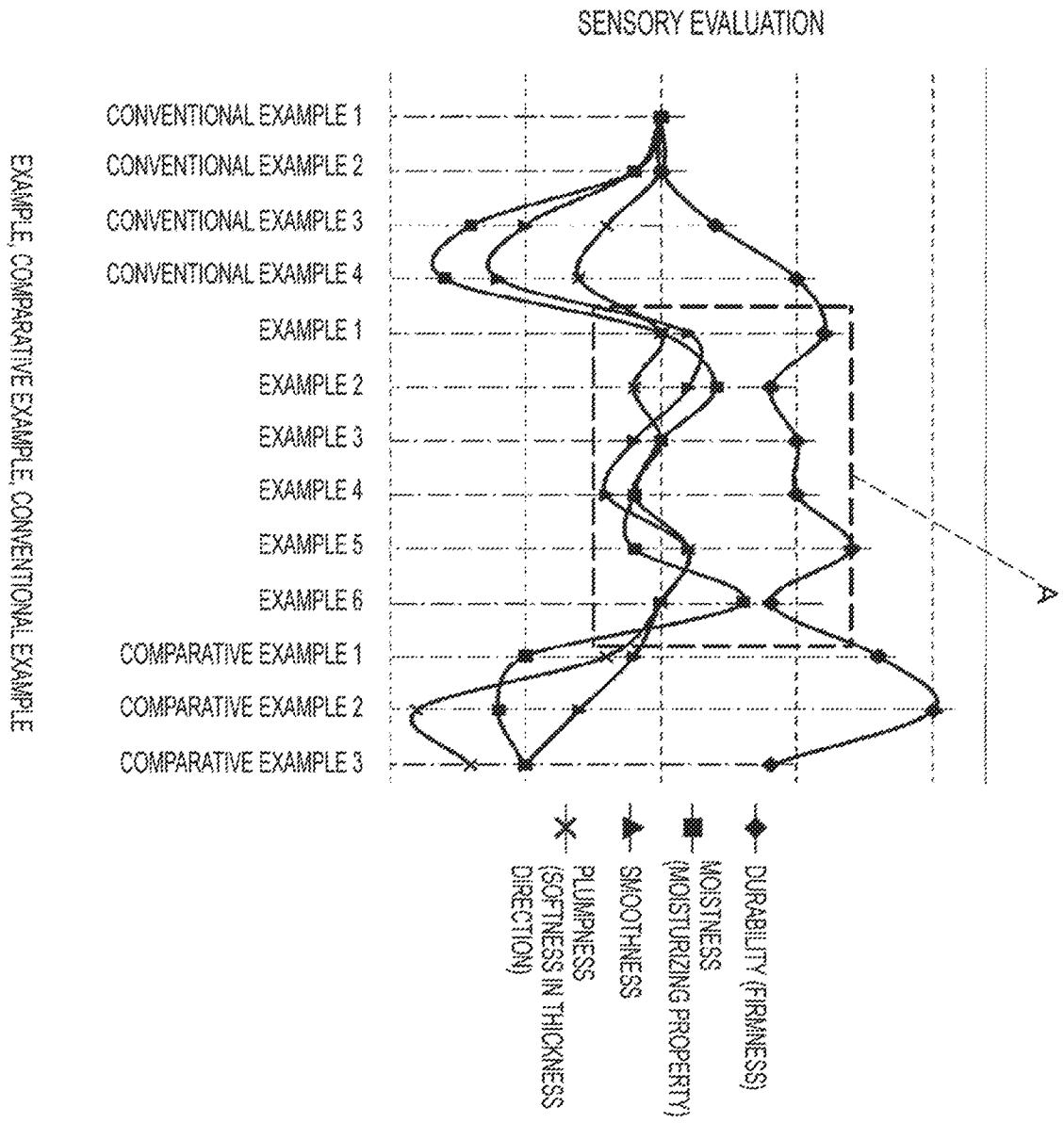
A
SENSORY EVALUATION
CONVENTIONAL EXAMPLE 1
CONVENTIONAL EXAMPLE 2
CONVENTIONAL EXAMPLE 3
CONVENTIONAL EXAMPLE 4
EXAMPLE 1
EXAMPLE 2
EXAMPLE 3
EXAMPLE 4
EXAMPLE 5
EXAMPLE 6
COMPARATIVE EXAMPLE 1
COMPARATIVE EXAMPLE 2
COMPARATIVE EXAMPLE 3
EXAMPLE, COMPARATIVE EXAMPLE, CONVENTIONAL EXAMPLE
DURABILITY (FIRMNESS)
MOISTNESS (MOISTURIZING PROPERTY)
SMOOTHNESS
PLUMPNESS (SOFTNESS IN THICKNESS DIRECTION)

TISSUE PAPER

TECHNICAL FIELD

The present invention relates to a tissue paper, particularly to a tissue paper containing a moisturizer.

BACKGROUND ART

A moisturizing tissue containing a moisturizer has a high moisture content due to a hygroscopic effect of the moisturizer, and therefore easily provides feeling of good "texture" such as "moistness" or "smoothness". This moisturizing tissue particularly has excellent "moistness" and "smoothness", and therefore has been often used for direct contact with the skin, for example, for blowing one's nose or removing makeup.

Meanwhile, as one of disadvantages of the tissue paper containing a moisturizer, due to a large content of moisture, when one's nose is strongly blown, nasal mucus goes through the tissue paper and adheres to a finger, that is, so-called strike through occurs, or the tissue paper easily breaks when being used for wiping the mouth or an object.

A tissue paper may be used for direct contact with the skin and also for wiping off an object. A tissue paper called a general-purpose type not containing a moisturizer may be used for wiping off an object. However, for example, due to spread of a moisturizing tissue, it is becoming more frequent to wipe off an object even with a moisturizing tissue.

Meanwhile, a use mode of a tissue paper varies depending on a region of the world. There is also a region where a moisturizing tissue is generally used for wiping off an object without using different tissue papers for the skin and for an object.

However, when a conventional moisturizing tissue is used for wiping off an object, the conventional moisturizing tissue easily provides feeling of "lack in strength", "anxiety", or "insufficient". Therefore, in a region where different tissue papers are used for the skin and for an object, it has not become general to use a moisturizing tissue for an object. Meanwhile, in a region where it is not general to use a general-purpose type tissue and a moisturizing tissue for different purposes, it has been required to eliminate anxiety such as "lack in strength" during use.

CITATION LIST

Patent Literature

Patent Literature 1: JP 05859593 B2

SUMMARY OF INVENTION

Technical Problem

Therefore, a main object of the present invention is to provide a moisturizing tissue having excellent "texture" such as "moistness" or "smoothness" peculiar to a moisturizing tissue, also having excellent "durability (firmness)", and easily used for multiple uses from a facial use such as blowing one's nose or wiping the mouth to a use for wiping off an object.

Solution to Problem

Means for solving the above problems are as follows.

A first means is a tissue paper containing a polyol, the tissue paper having:

a basis weight of 15.6 to 19.1 g/m$^2$ and a paper thickness of 115 to 150 μm;

a content of the polyol of 17.0 to 22.0% by mass and a moisture content of 10% by mass or more;

a dry tensile strength of 310 to 410 cN/25 mm in a longitudinal direction, a dry tensile strength of 120 to 160 cN/25 mm in a lateral direction, and a wet tensile strength of 55 to 90 cN/25 mm in the lateral direction; and compression energy WC of 5.0 to 6.5 gf·cm/cm2 under a load of 50 g/cm$^2$ in a KES test method.

The second means is the tissue paper according to the first means, having a longitudinal elongation percentage of 13.2 to 17.9% when being dry.

The third means is the tissue paper according to the first or second means, having recoverability RC of 45 to 50% under a load of 50 g/cm$^2$ in the KES test method.

Advantageous Effects of Invention

The present invention described above provides a moisturizing tissue having excellent "texture" such as "moistness" or "smoothness" peculiar to a moisturizing tissue, also having excellent "durability (firmness)", and easily used for multiple uses from a facial use such as blowing one's nose or wiping the mouth to a use for wiping off an object.

BRIEF DESCRIPTION OF DRAWINGS

FIG. 1 is a graph of evaluation results according to Examples.

DESCRIPTION OF EMBODIMENTS

Hereinafter, embodiments of the present invention will be described.

The tissue paper according to the present embodiment is a two-ply tissue paper, that is, a tissue paper obtained by stacking two base sheets to be integrated into one set. It is desirable that pulp fibers constituting the tissue paper contain needle bleached kraft pulp (NBKP) and leaf bleached kraft pulp (LBKP). Particularly, the pulp fibers preferably contain only NBKP and LBKP. A blend ratio thereof is preferably NBKP:LBKP=20:80 to 80:20, and particularly desirably NBKP:LBKP=30:70 to 60:40. By such blending, a balance between dry and wet tensile strengths and a surface property can be favorably adjusted. It is desirable that NBKP is a needle bleached kraft pulp having a fiber roughness of 11.0 mg/100 m to 20.0 mg/100 m because NBKP provides a flexible base paper having a strength. It is desirable that LBKP is a leaf bleached kraft pulp having a fiber roughness of 7.0 to 13.0 mg/100 m because LBKP provides a base paper having a smooth surface property.

The tissue paper according to the present embodiment has a basis weight of 15.9 g/m$^2$ or more and 19.1 g/m$^2$ or less per ply. This basis weight is higher than that of a general-purpose tissue paper called a general-purpose product or a low-priced product. With this basis weight, a tissue paper having excellent softness, smoothness, and durability can be provided. The tissue paper according to the present embodiment has a two-ply paper thickness of 115 μm or more. An upper limit is not necessarily limited. However, it is desirable that the upper limit is 150 μm or less. With this paper thickness, a tissue paper having excellent softness, smoothness, and durability can be achieved.

The tissue paper according to the present embodiment has a high basis weight and a large paper thickness, and therefore effectively enhances "moist feeling" due to an increase in moisture content by a polyol or the like.

Note that the basis weight in the present invention means a value measured according to JIS P 8124 (1998). The paper thickness means a value obtained by sufficiently subjecting a test piece to humidity control under conditions of JIS P 8111 (1998), and then measuring the paper thickness using a dial thickness gauge (thickness measuring instrument) "PEACOCK G type" (manufactured by Ozaki MFG. Co., Ltd.) under the same conditions. Specifically, the paper thickness is measured by confirming that there is no rubbish, dust, or the like between a plunger and a measuring table, placing the plunger on the measuring table, moving a scale of the dial thickness gauge to adjust a zero point, then raising the plunger, placing a sample on a test table, lowering the plunger slowly, and reading the current gauge. At this time, the plunger is just placed. A terminal of the plunger is made of metal, and a circular plane thereof with a diameter of 10 mm strikes perpendicularly to a paper plane, and a load is about 70 gf when the paper thickness is measured. The paper thickness is an average value obtained by performing the measurement 10 times.

The tissue paper according to the present embodiment is a tissue paper containing a moisturizer, also referred to as a moisturizing tissue, a lotion tissue, a chemical-containing tissue, or the like. The moisturizer according to the present embodiment mainly contains a polyol for taking moisture into a paper due to a hygroscopic property thereof to increase a moisture content. Therefore, the tissue paper according to the present embodiment contains a polyol. The polyol is an aliphatic compound having two or more hydroxy groups —OH, and has an effect of improving a moisture content due to a hygroscopic property thereof. A hygroscopic sugar is also included. Examples of a suitable polyol according to the present embodiment include glycerin, diglycerin, triglycerin, propylene glycol, 1,3-butylene glycol, polyethylene glycol, sorbitol, glucose, xylitol, maltose, maltitol, mannitol, trehalose, arabinose, galactose, xylose, xylobiose, xylooligosaccharide, sucrose, and rhamnose. A mixture thereof may also be used. Examples of a particularly suitable polyol include glycerin, diglycerin, and a mixture thereof.

Examples of components other than the main component in the moisturizer according to the present embodiment include aloe extract, Isodon japonicus extract, hypericum extract, barley extract, orange extract, seaweed extract, chamomile extract, cucumber extract, comfrey extract, burdock extract, shiitake mushroom extract, rehmannia root extract, perilla extract, sage extract, duke extract, Cordyceps extract, *Houttuynia cordata* extract, *Lyophyllum decastes* extract, loquat extract, grape leaf extract, *Tilia cordata* extract, prune extract, loofah extract, moutan bark extract, *Rosa maikwai* extract, peach leaf extract, lily extract, apple extract, almond oil, olive oil, sesame oil, safflower oil, soybean oil, camellia oil, castor oil, jojoba oil, mink oil, coconut oil, beeswax, hyaluronic acid, placenta extract, rhamnose, xylobiose, xylooligosaccharide, tuberose polysaccharide, trisaccharide, soluble collagen, glycyrrhizin, chondroitin sulfate, squalane, a ceramide-like compound, urea, a vitamin C phosphate calcium salt, vitamin E, sodium pyrrolidonecarboxylate, hinokitiol, liquid paraffin, and vaseline. These compounds may be contained singly or in combination of two or more kinds thereof. Among these compounds, aloe extract, *Isodon japonicus* extract, hypericum extract, comfrey extract, perilla extract, sage extract, a ceramide-like compound, *Houttuynia cordata* extract, *Lyophyllum decastes* extract, loquat extract, *Tilia cordata* extract, moutan bark extract, castor oil, jojoba oil, hyaluronic acid, placenta extract, soluble collagen, chondroitin sulfate, squalane, and urea are more preferable.

The content of a polyol in the tissue paper according to the present embodiment is 17.0% by mass or more and 22.0% by mass or less. The content of a polyol is determined, for example, from a value measured by quantification with a gas chromatography hydrogen flame ionization detector. Using a humidity-controlled tissue paper as a standard sample, acetone extraction is performed with a Soxhlet extractor. The solvent used for extraction is dried, and the resulting product is put into a gas chromatography hydrogen flame ionization detector. A ratio of the total mass of polyols such as glycerin contained in the tissue paper that has been subjected to moisture control under conditions of JIS P 8111(1998) is defined as % by mass of the content of the polyols. With the above content, the moisture content in the tissue paper is easily increased to 10% by mass or more.

The tissue paper according to the present invention contains a polyol and the like as a moisturizer as described above, and thereby particularly has a moisture content of 10% by mass or more, and particularly has a moisture content of 11% by mass or more. This moisture content is high among moisture contents of moisturizing tissues. A high moisture content easily provides feeling of "moist feeling". Note that the moisture content here is a value obtained by sufficiently subjecting a sample to humidity control under conditions of JIS P 8111 (1998) and then measuring a moisture content on the basis of JIS P 8127 (1998). Specifically, using a tissue paper which has been subjected to humidity control under the standard conditions of JIS P 8111 as a sample, the tissue paper is dried in an environment of 65° C. and 20%, and a ratio of a moisture amount in the tissue paper with respect to the mass of the humidity-controlled tissue paper is determined by the following formula.

(moisture content % of tissue paper)=((mass g of humidity-controlled tissue paper)−(mass g of dried tissue paper))/(mass g of humidity-controlled tissue paper))

The moisturizer in the tissue paper according to the present embodiment is preferably externally added to a base paper as a chemical. The chemical can be externally added to a base paper by a known technique such as spray application, printing application, or roll transfer. Note that the chemical can contain a known auxiliary agent such as an emulsifier, an antiseptic agent, or an antifoaming agent.

Meanwhile, the tissue paper according to the present embodiment has a dry tensile strength of 310 to 410 cN/25 mm in a longitudinal direction and a dry tensile strength of 120 to 160 cN/25 mm in a lateral direction. The values of the dry tensile strength in the lateral and longitudinal directions are high values for a moisturizing tissue, and are almost the same as those of a non-moisturizing tissue.

The tissue paper according to the present embodiment has a dry tensile strength of 120 to 160 cN/25 mm in the lateral direction and a wet tensile strength of 55 to 90 cN/25 mm in the lateral direction as described above. When the dry tensile strength and the wet tensile strength in the lateral direction are within these ranges within the above ranges of the basis weight and the paper thickness, moderate elasticity is achieved, and excellent "moist feeling" is achieved in combination with the high moisture content due to the content of a polyol. The tissue paper according to the present invention has a high wet tensile strength particularly in the lateral direction. The wet tensile strength in the lateral direction is generally the weakest value among values of the dry tensile strength of a tissue paper in the longitudinal and lateral directions and values of the wet tensile strength of the tissue paper in the longitudinal and lateral directions. Therefore, when a tissue paper has a high value of the wet tensile strength in the lateral direction, the paper itself can be said to be essentially durable, and provides excellent "durability (firmness)" also in terms of how to feel the tissue paper.

Note that the dry tensile strength according to the present embodiment is measured on the basis of the tensile test of JIS P 8113 (1998). As a test piece, a tissue paper cut into a size of about 25 mm (±0.5 mm) (width)×about 150 mm (length) in both the longitudinal and lateral directions is used. In a case of a multi-ply tissue paper, the measurement is performed with multiple plies. As a tester, a load cell tensile tester TG-200N manufactured by Minebea Co., Ltd. is used. A grip interval is set to 100 mm. The measurement is performed by tightening both ends of the test piece to a grip of the tester, applying a tensile load to the paper piece in an up-down direction, and reading an indicated value (digital value) when the paper breaks. A pulling speed is 100 mm/min. Five sets of samples are prepared in each of the longitudinal direction and the lateral direction, and each sample is measured five times. An average of the measured values is defined as a dry tensile strength in each of the directions. (A sample was adjusted according to JIS P 8111 (1998))

A wet tensile strength is measured according to the tensile test of JIS P 8135 (1998). As a test piece, a tissue paper cut into a size of about 25 mm (±0.5 mm) (width)×about 150 mm (length) in both the longitudinal and lateral directions is used. In a case of a multi-ply tissue paper, the measurement is performed with multiple plies. As a tester, a load cell tensile tester TG-200N manufactured by Minebea Co., Ltd. is used. A grip interval is set to 100 mm. The measurement is performed by tightening both ends of the test piece which has been cured for 10 minutes with a dryer at 105° C. to a grip of the tester, then horizontally applying water to a central portion of the test piece with a width of about 10 mm using a flat brush containing water, immediately thereafter applying a tensile load to the paper piece in an up-down direction, and reading a value (digital value) when the paper breaks. A pulling speed is 50 mm/min. Five sets of samples are prepared in each of the longitudinal direction and the lateral direction, and each sample is measured five times. An average of the measured values is defined as a wet tensile strength in each of the directions.

Meanwhile, the tissue paper according to the present embodiment has an elongation percentage (stretch at break) of 13.2 to 17.9%. The elongation percentage is a value measured on the basis of the tensile test of JIS P 8113 (1998). The measurement can be performed by "universal tensile compression tester TG-200N" manufactured by Minebea Co., Ltd. or a machine equivalent thereto. When the elongation percentage is within the above range, a tissue paper easily provides feeling of "smoothness".

Here, the tissue paper of the present invention has a high wet tensile strength in the lateral direction and a high dry tensile strength in the lateral direction as described above. It is known that the dry and wet tensile strengths in the lateral direction correlate with "softness" in sensory evaluation. When the tensile strength in the lateral direction is simply increased, it is difficult to feel "softness". Particularly when the tensile strength is within about the same range as a non-moisturizing tissue like the tensile strength according to the present embodiment, it may be difficult to feel "softness" equivalent to or more than a conventional moisturizing tissue. In this case, particularly when a ratio between the wet tensile strength and the dry tensile strength in the lateral direction ((wet tensile strength in lateral direction)/(dry tensile strength in lateral direction)) is set to 0.35 to 0.70, "softness" peculiar to a moisturizing tissue is more easily exhibited. Therefore, the tensile strength in the lateral direction when the tissue paper is dry or wet are preferably adjusted to fall within the above range. Furthermore, it is desirable that the aspect ratio of a tissue paper base paper is 2.4 to 2.9 before a moisturizer is added. The longitudinal dry tensile strength can be suppressed to provide a soft paper quality and to secure softness during use, and the lateral dry tensile strength can be increased to secure resistance to break when the tissue paper is wet.

Furthermore, the tissue paper according to the present embodiment has a high tensile strength in the lateral direction, but also has predetermined characteristics in the KES test method. With these characteristics, particularly in addition to "moist feeling" and "smoothness", the tissue paper has "durability (firmness)" but also has "plumpness", and easily provides softness in the thickness direction.

The tissue paper according to the present embodiment has compression energy WC of 5.0 to 6.5 gf·cm/cm2 under a load of 50 g/cm$^2$ in the KES test method. The higher the compression energy WC is, the more easily the tissue paper is mechanically compressed in the thickness direction and the more easily the tissue paper sinks in the thickness direction. Therefore, the compression energy WC can be used as an index of softness in the thickness direction. When the compression energy WC is 5.0 to 6.5 gf·cm/cm2, the tissue paper sinks in the thickness direction during use so as to provide feeling of moderate softness, and provides feeling of "softness" while having a high tensile strength in the lateral direction as described above. The compression energy WC under a load of 50 g/cm$^2$ in the KES test method is a value measured by a handy compression measurement program under the following measurement conditions using a compression tester KES-G5 manufactured by Kato Tech Co., Ltd. or a machine equivalent thereto. In the measurement, 20 sets (40 sheets) of the tissue paper are stacked, and the compression energy WC is measured at arbitrary five points. An average of the values measured at the five points of the 20 sets of the tissue paper is used as a measurement value.

(Measurement Conditions)

Dynamometer: 1 kg

Compression (pressurization) area: 2 cm$^2$

Compression speed: 0.2 cm/sec

Maximum compression load (upper limit load): 50 gf/cm$^2$

Number of compression repetitions for one point: one time

STOROKE SET: 2

SENS: 5

Measurement environment: standard temperature and humidity (23° C./50% RH)

Furthermore, it is desirable that the tissue paper according to the present embodiment has recoverability RC of 45 to 50% under a load of 50 g/cm$^2$ in the KES test method. The recoverability RC by the KES method means that the closer to 100%, the larger the recoverability in the height direction. When the recoverability RC is 45 to 50%, moderate resilience easily provides feeling of "plumpness", reduces rigidity of the entire tissue paper, and easily provides feeling of "softness". When the recoverability is too high, there is too much resilience, and feeling of softness is not provided.

Similarly to the compression energy WC, the recoverability RC by the KES method is a value measured by a handy compression measurement program under the following measurement conditions using a compression tester KES-G5 manufactured by Kato Tech Co., Ltd. or a machine equivalent thereto. The measurement conditions are similar to the above (measurement conditions) of the compression energy WC.

By enhancing a paper strength and adding a large amount of a polyol, the tissue paper according to the present embodiment has excellent "durability (firmness)" in addition to "moist feeling" and "smoothness", and at the same time, hardly provides feeling of rigidity due to the high paper strength by the softness in the thickness direction to provide feeling of "softness" peculiar to a moisturizing tissue, although this is not necessarily certain.

Here, the tissue paper according to the present embodiment is a moisturizing tissue, and is manufactured by applying a moisturizer containing a polyol to a base paper-stacked sheet in an amount of about 20 to 30% by mass. Generally, the dry tensile strength is often reduced by 30% to 40%, and the wet strength is often reduced by 20% to 30% with respect to a base paper containing no chemical due to moisture in the chemical and moisture absorption after application of the chemical. Therefore, in the tissue paper according to the present embodiment, it is desirable that the dry tensile strength and the wet tensile strength of a primary base paper to be made are increased as compared with a conventional product. Specifically, it is desirable that the longitudinal dry tensile strength is 500 to 650 cN/25 mm, the lateral dry tensile strength is 200 to 330 cN/25 mm, and the lateral wet tensile strength is 80 to 150 cN/25 mm. In the present invention, it is easy to adjust the strength within this range by adjusting the basis weight of the base paper to 12.0 to 17.5 g/m$^2$ for a one-ply tissue paper, and to adjust the paper thickness to 130 to 180 μm for a two-ply tissue paper.

Furthermore, when the base paper is made, the strength only needs to be adjusted by adjusting blending of raw materials, beating conditions, the kind of a dry paper strength enhancer, the kind of a wet paper strength enhancer, a blending ratio between the dry paper strength enhancer and the wet paper strength enhancer, and the like. However, in order to increase the dry tensile strength and the wet tensile strength, only an increase in the amounts of the dry paper strength enhancer and the wet paper strength enhancer added to the raw materials as compared with conventionally added amounts may cause the yield of a paper strength agent to reach a ceiling, and necessary dry tensile strength and wet tensile strength cannot be obtained in some cases. In this case, when the aspect ratio (longitudinal dry tensile strength)/(lateral dry tensile strength) of the base paper is set to 2.4 to 2.9 as described above, the tissue paper of the present invention can be easily obtained.

Particularly suitable examples of the dry paper strength agent in the tissue paper according to the present embodiment include cationized starch and a cationic or amphoteric polyacrylamide-based copolymer. Particularly, cationized starch is desirable as a dry paper strength agent. It is desirable that the content of the dry paper strength agent is 0.1 to 2.0 parts by mass with respect to 100 parts by mass of pulp fibers. Examples of the wet paper strength agent include a urea formaldehyde resin, a melamine formaldehyde resin, polyamide polyamine epichlorohydrin (PAE), and polyvinyl amine (PVAm). Particularly, a polyaminopolyamine epichlorohydrin resin is desirable as the wet paper strength agent. It is desirable that the content of the wet paper strength agent is 0.1 to 1.0 part by mass with respect to 100 parts by mass of pulp fibers. A polyaminopolyamine epichlorohydrin resin and cationized starch can effectively improve paper strength without inhibiting an effect of improving softness and smoothness due to an increase in moisture content by a polyol. By using the polyaminopolyamine epichlorohydrin resin and cationized starch, the tissue paper according to the present embodiment has better softness and smoothness, has improved strength, and has an extremely high sensory evaluation value by a consumer. Note that it is desirable that the dry paper strength agent and the wet paper strength agent are internally added.

Specifically, when 8.0 to 11.0 kg/pulp ton polyamide polyamine epichlorohydrin (PAE) is added to 4.0 to 8.0 kg/pulp ton cationized starch, fixing of both cationized starch and polyamide polyamine epichlorohydrin (PAE) to the pulp is improved, and the dry strength and the wet strength, particularly the wet strength is remarkably improved. A ratio between cationized starch and polyamide polyamine epichlorohydrin (PAE), having a high fixing ratio and a high effect of improving the dry strength and the wet strength, is preferably 30:70 to 55:45. Within this range, fixing of both the dry paper strength agent and the wet paper strength agent to raw materials is favorable, and desired dry and wet strengths can be obtained.

In the tissue paper according to the present embodiment, the compression energy WC and the recoverability RC are easily adjusted within the above range by the described adjustment of paper strength and the application amount of a moisturizer, particularly the content of a polyol, and further by externally adding the moisturizer to a base paper such that the crepe ratio of the base paper is 20% or less, particularly 18% or less, and more preferably 15% or less. In addition, adjustment of a creping doctor angle and the width of a doctor blade during papermaking, a pulp blending ratio between, for example, needle-leaved tree and broad-leaved tree, and beating of pulps are also adjustment factors. Of course, another adjustment technique can be used. For example, the compression energy WC and the recoverability RC can also be adjusted by using a fatty acid ester-based compound or a fatty acid amide-based compound as a softener.

Meanwhile, the tissue paper according to the present embodiment does not have to contain an internal addition softener to be internally added when a base paper is made. The softener can increase softness of the base paper itself, but it affects the paper strength, and particularly tends to decrease the paper strength. In the tissue paper according to the present embodiment, by adding no internal addition softener to the tissue paper or decreasing the use amount thereof, adjusting the paper strength of the base paper to a high value, and enhancing the action of a polyol and the like, high sensory evaluation in terms of "moist feeling", "smoothness", and "durability (firmness)" is easily obtained. Note that when a softener is used, suitable examples of the softener include a fatty acid ester-based compound and a fatty acid amide-based compound. The fatty acid ester-based compound has an effect of improving wettability and plumpness (fluffiness) of a surface of the tissue paper, and the fatty acid amide-based compound has an effect of coating a fiber surface. The fatty acid ester-based compound may be either a cationic fatty acid ester-based compound or a nonionic fatty acid ester-based compound, but it is desirable that both of these compounds are contained. It is desirable that the fatty acid ester-based compound is a compound of an alcohol having 6 to 24 carbon atoms and a fatty acid having 7 to 25 carbon atoms. The alcohol may be any one of a linear alcohol, a branched alcohol, a saturated alcohol, and an unsaturated alcohol. Particularly, an alcohol having 10 to 22 carbon atoms is preferable, and lauryl alcohol, myristyl alcohol, cetyl alcohol, stearyl alcohol, behenyl alcohol, and oleyl alcohol are preferable. These alcohols may be used singly or in combination of two or more kinds thereof. The fatty acid having 7 to 25 carbon atoms may be any one of a linear fatty acid, a branched fatty acid, a saturated fatty acid, and an unsaturated fatty acid. Particularly, a fatty acid having 10 to 22 carbon atoms is preferable, and lauric acid, myristic acid, palmitic acid, stearic acid, behenic acid, and oleic acid are preferable. These alcohols may be used singly or in combination of two or more kinds thereof.

The fatty acid amide-based compound can be obtained by a reaction between a polyalkylene polyamine and a carboxylic acid. A suitable polyalkylene polyamine is a compound having at least three amino groups in a molecule thereof, represented by the following formula (1).

$$H_2N—(R_1—NH—)_n—R_1—NH_2 \quad (1)$$

($R_1$s each independently represent an alkylene group having 1 to 4 carbon atoms, and n represents an integer of 1 to 3)

In this polyacrylic amine, different $R_1$s may exist in a molecule thereof. Two or more polyalkylene polyamines can also be used. $R_1$ is preferably an ethylene group. It is desirable that the carboxylic acid is a carboxylic acid having 10 to 24 carbon atoms. The carboxylic acid may be either a saturated carboxylic acid or an unsaturated carboxylic acid. The carboxylic acid may be either a linear carboxylic acid or a branched carboxylic acid. Among these carboxylic acids, a carboxylic acid having 12 to 22 carbon atoms is preferable, and a carboxylic acid having 14 to 18 carbon atoms is particularly preferable.

In a case where a softener is contained, when the softener is a fatty acid ester-based compound, the content of the fatty acid ester-based compound is 0.01 parts by mass to 0.20 parts by mass with respect to 100 parts by mass of pulp fibers, and when the softener is a fatty acid amide-based compound, the content of the fatty acid amide-based compound is 0.01 parts by mass to 0.30 parts by mass with respect to 100 parts by mass of pulp fibers.

Note that the tissue paper according to the present embodiment is suitable for use as a pop-up type tissue paper product contained in a storage box also called a carton box. In this case, in order to form a pop-up type bundle of tissue paper to be contained in the storage box, it is desirable to use a rotary type inter folder having excellent folding quality.

EXAMPLES

Next, physical property values and results of sensory evaluation in the moisturizing tissue paper according to the present embodiment (Examples 1 to 6), moisturizing type tissue papers as comparative examples thereof (Comparative Examples 1 to 3), and Conventional Examples 1 to 4 adopting moisturizing tissues are illustrated in Table 1 below. FIG. 1 illustrates a graph of results of sensory evaluation in Examples, Conventional Examples, and Comparative Examples.

In Examples and Comparative Examples, raw material pulps were blended by setting a ratio of NBKP:LBKP to 50:50 such that the ratio of NBKP was slightly high as a tissue paper, and paper was made with a circular net Yankee dryer paper machine.

Cationic starch was used as a dry paper strength agent, and a polyaminopolyamine epichlorohydrin resin was used as a wet paper strength agent. Two sheets of the tissue paper base paper were stacked to form stacked tissue paper base paper, and a moisturizer was added in an amount of about 20% by mass to the stacked tissue paper base paper depending on the basis weight and the like by a gravure printing method such that the values in Table were obtained as the content of a polyol. As the moisturizer, an aqueous chemical containing glycerin as a main component, 75% by mass of glycerin as a polyol, 20% by mass of water, and 5% by mass of other auxiliary components was used. The aqueous chemical had a viscosity of 110 mPa·s at 40° C.

The stacked continuous sheet containing the moisturizer was processed by a rotary type inter folder to obtain a cut sheet.

Softness and MMD in Table were measured as follows.

[Softness]

Softness was measured on the basis of a handle-o-meter method according to a JIS L 1096 E method. However, a test piece had a size of 100 mm×100 mm, and a clearance was set to 5 mm. Measurement was performed five times in each of a longitudinal direction and a lateral direction with a one-ply tissue paper, and an average value of all the ten values was represented in unit of cN/100 mm.

[MMD]

While a contact surface of a friction element is brought into contact with a surface of a measurement sample to which a tension of 20 g/cm is applied in a predetermined direction at a contact pressure of 25 g, the measurement sample is moved by 2 cm in substantially the same direction as the direction in which the tension is applied at a speed of 0.1 cm/s, and a friction coefficient at this time is measured using a friction sense tester KES-SE (manufactured by Kato Tech Co., Ltd.). A value obtained by dividing the friction coefficient by a friction distance (moving distance=2 cm) is MMD. The friction element is formed by adjoining 20 piano wires P each having a diameter of 0.5 mm, and has a contact surface formed such that the length and the width were both 10 mm. On the contact surface, a unit bulging portion having a tip formed with 20 piano wires P (radius of curvature: 0.25 mm) is formed.

[Sensory Evaluation]

Conventional Example 1 adopting a conventionally commercially available two-ply moisturizing tissue was used as a reference sample, and samples in Examples, Conventional Examples, and Comparative Examples were evaluated in seven grades with respect to the reference sample. As evaluation items, "durability (firmness)", "moist feeling (moisturizing property)", "smoothness", and "plumpness (softness in thickness direction)" after a tissue paper was freely touched were used. The number of subjects was 20, and an average of values evaluated by the subjects was used for evaluation.

TABLE 1

| | | | Example 1 | Example 2 | Example 3 | Example4 | Example 5 | Example 6 |
|---|---|---|---|---|---|---|---|---|
| Making of base paper | Blending of pulp | | | | | | | |
| | NBKP | % | 50 | 50 | 50 | 50 | 50 | 50 |
| | LBKP | % | 50 | 50 | 50 | 50 | 50 | 50 |
| | Crepe ratio | % | 14 | 14 | 14 | 14 | 14 | 14 |
| | Dry paper | kg/pulp | 5.0 | 5.0 | 5.0 | 5.0 | 5.0 | 5.0 |

TABLE 1-continued

| | | | | | | | | |
|---|---|---|---|---|---|---|---|---|
| | strength agent | ton | | | | | | |
| | Wet paper strength agent | kg/pulp ton | 8.5 | 8.5 | 10.25 | 10.25 | 8.5 | 8.5 |
| | Base weight | $g/m^2$ | 14.2 | 14.3 | 14.4 | 14.4 | 14.0 | 13.9 |
| | Paper thickness | μm | 144 | 145 | 142 | 144 | 146 | 140 |
| | Dry tensile strength (longitudinal direction) | cN | 556 | 531 | 596 | 550 | 600 | 512 |
| | Dry tensile strength (lateral direction) | cN | 273 | 256 | 280 | 266 | 294 | 233 |
| | Wet tensile strength (lateral direction) | cN | 97 | 94 | 122 | 108 | 95 | 89 |
| Paper quality of product | Application ratio of moisturizer | % | 24.1 | 26.4 | 25.5 | 22.7 | 23.6 | 25.7 |
| Paper quality of product | Content of polyol | % | 18.3 | 20.1 | 19.4 | 17.3 | 17.9 | 19.5 |
| | Kind | — | Moisturizing | Moisturizing | Moisturizing | Moisturizing | Moisturizing | Moisturizing |
| | Base weight | g/m2 | 16.7 | 16.9 | 17.6 | 17.4 | 16.6 | 16.9 |
| | Number of plies | ply | 2 | 2 | 2 | 2 | 2 | 2 |
| | Paper thickness | μm | 139 | 139 | 138 | 136 | 140 | 137 |
| | Dry tensile strength (longitudinal direction) | cN | 372 | 335 | 342 | 356 | 395 | 319 |
| | Dry tensile strength (lateral direction) | cN | 148 | 130 | 131 | 129 | 155 | 123 |
| | Wet tensile strength (lateral direction) | cN | 58 | 61 | 85 | 86 | 65 | 57 |
| | Elongation | % | 16.0 | 15.7 | 14.5 | 15.1 | 16.4 | 15.1 |
| | Softness | cN | 1.3 | 1.2 | 1.2 | 1.2 | 1.4 | 1.2 |
| | MMD | — | 6.0 | 6.1 | 6.9 | 8.3 | 6.0 | 6.1 |
| | Moisture content | % | 12.0 | 12.6 | 13.2 | 12.8 | 12.1 | 13.1 |
| KES test | Compression energy WC | gf · cm/cm2 | 5.4 | 5.4 | 6.2 | 5.4 | 6.2 | 5.8 |
| | Recoverability | % | 47.7 | 47.2 | 47.1 | 48.2 | 49.5 | 46.2 |
| | T0 | mm | 8.1 | 9.3 | 11.4 | 8.3 | 8.7 | 8.2 |
| | TM | mm | 5.5 | 5.8 | 6.0 | 5.4 | 6.1 | 5.7 |
| | TM − TO | mm | 2.6 | 3.5 | 5.4 | 2.8 | 2.6 | 2.5 |
| Sensory evaluation Evaluation based on seven grades | Durability (firmness) | | 4.6 | 4.4 | 4.5 | 4.5 | 4.7 | 4.4 |
| | Moist feeling (moisturizing property) | | 4.0 | 4.2 | 4.0 | 3.9 | 3.9 | 4.3 |
| | Smoothness | | 4.1 | 4.1 | 3.9 | 3.8 | 4.1 | 4.0 |
| | Plumpness (softness in thickness direction) | | 4.0 | 3.9 | 4.0 | 3.9 | 4.1 | 4.0 |

| | | | Comparative Example 1 | Comparative Example 2 | Comparative Example 3 | Conventional Example 1 | Conventional Example 2 | Conventional Example 3 | Conventional Example 4 |
|---|---|---|---|---|---|---|---|---|---|
| Making of base paper | Blending of pulp | | | | | | | | |
| | NBKP | % | 50 | 50 | 50 | 50 | 50 | — | — |
| | LBKP | % | 50 | 50 | 50 | 50 | 50 | — | — |
| | Crepe ratio | % | 14 | 14 | 14 | 14 | 14 | — | — |
| | Dry paper strength agent | kg/pulp ton | 5.0 | 5.0 | 5.0 | 0 | 0 | — | — |
| | Wet paper strength agent | kg/pulp ton | 10.25 | 10.25 | 10.25 | 8.5 | 10.25 | — | — |
| | Base weight | $g/m^2$ | 14.5 | 14.1 | 14.0 | 14.2 | 13.8 | — | — |
| | Paper thickness | μm | 145 | 138 | 150 | 195 | 186 | — | — |
| | Dry tensile strength (longitudinal direction) | cN | 625 | 656 | 551 | 335 | 320 | — | — |
| | Dry tensile strength (lateral direction) | cN | 252 | 291 | 248 | 142 | 156 | — | — |
| | Wet tensile strength | cN | 100 | 121 | 95 | 63 | 70 | — | — |

TABLE 1-continued

| | | | | | | | | | |
|---|---|---|---|---|---|---|---|---|---|
| | (lateral direction) | | | | | | | | |
| Paper quality of product | Application ratio of moisturizer | % | 19.7 | 16.5 | 20.3 | 25.4 | 24.8 | — | — |
| Paper quality of product | Content of polyol | % | 15.0 | 12.5 | 15.4 | 19.3 | 18.8 | — | — |
| | Kind | — | Moisturizing | Moisturizing | Moisturizing | Moisturizing | Moisturizing | Moisturizing | Moisturizing |
| | Base weight | g/m2 | 17.4 | 16.2 | 17.0 | 17.0 | 16.8 | 15.0 | 16.0 |
| | Number of plies | ply | 2 | 2 | 2 | 2 | 2 | 3 | 3 |
| | Paper thickness | μm | 136 | 122 | 120 | 151 | 148 | 301 | 279 |
| | Dry tensile strength (longitudinal direction) | cN | 419 | 510 | 361 | 205 | 224 | 325 | 405 |
| | Dry tensile strength (lateral direction) | cN | 137 | 166 | 138 | 74 | 86 | 124 | 179 |
| | Wet tensile strength (lateral direction) | cN | 85 | 103 | 74 | 44 | 49 | 54 | 53 |
| | Elongation | % | 15.3 | 16.4 | 11.1 | 15.3 | 15.1 | 16.3 | 17.0 |
| | Softness | cN | 1.3 | 1.0 | 0.9 | 0.9 | 0.8 | 1.2 | 1.3 |
| | MMD | — | 8.3 | 6.8 | 7.6 | 5.9 | 5.8 | 10.8 | 9.4 |
| | Moisture content | % | 12.8 | 12.1 | 12.2 | 12.5 | 11.8 | 8.13 | 7.63 |
| KES test | Compression energy WC | gf · cm/cm2 | 4.2 | 2.5 | 2.7 | 7.5 | 7.6 | 4.3 | 4.6 |
| | Recoverability | % | 52.2 | 66.0 | 70.5 | 35.0 | 32.4 | 52.8 | 51.8 |
| | T0 | mm | 8.3 | 5.7 | 5.7 | 7.3 | 7.4 | 15.3 | 15.3 |
| | TM | mm | 5.4 | 4.6 | 4.6 | 5.5 | 5.8 | 11.7 | 11.7 |
| | TM − TO | mm | 2.8 | 1.1 | 1.1 | 1.8 | 1.6 | 3.6 | 3.6 |
| Sensory evaluation Evaluation based on seven grades | Durability (firmness) | | 4.8 | 5.0 | 4.4 | 4.0 | 4.0 | 4.2 | 4.5 |
| | Moist feeling (moisturizing property) | | 3.5 | 3.4 | 3.5 | 4.0 | 3.9 | 3.3 | 3.2 |
| | Smoothness | | 3.9 | 3.7 | 3.5 | 4.0 | 3.9 | 3.5 | 3.4 |
| | Plumpness (softness in thickness direction) | | 3.8 | 3.1 | 3.3 | 4.0 | 4.0 | 3.8 | 3.7 |

In Conventional Examples 1 to 4 adopting moisturizing tissues, Conventional Examples 3 and 4 adopting three-ply tissues have higher evaluation of "durability (firmness)" but lower evaluation of "moist feeling (moisturizing property)", "smoothness", and "plumpness (softness in thickness direction)" than Conventional Examples 1 and 2 adopting two-ply tissues. In addition, Comparative Examples 1 to 3 adopt two-ply moisturizing tissues, and reduce the content of a polyol, the content being considered to affect the paper strength, in order to increase "durability (firmness)", and reduces the paper thickness such that softness can be easily exhibited. However, Comparative Examples 1 to 3 had low compression energy WC, and had evaluation in which any of "moist feeling (moisturizing property)", "smoothness", and "plumpness (softness in thickness direction)" was low. These results can be confirmed in FIG. 1. Examples of the present invention, indicated by the range A in FIG. 1, have higher evaluation in "durability (firmness)" than a conventional moisturizing tissue, and roughly maintain "moist feeling (moisturizing property)", "smoothness", and "plumpness (softness in thickness direction)". That is, the tissue paper in Examples of the present invention is durable, but also has "moist feeling (moisturizing property)", "smoothness", and "plumpness (softness in thickness direction)" as a moisturizing tissue, and further has "durability (firmness)".

The invention claimed is:

1. A two ply tissue paper comprising:

a two ply tissue paper sheet; and a polyol added to the two ply tissue paper sheet, the two ply tissue paper having:

(i) a basis weight per ply of 15.6 to 19.1 g/m$^2$ and a two ply paper thickness of 115 to 150 μm;

(ii) a content of the polyol of 17.0 to 22.0% by mass and a moisture content of 10% by mass or more;

(iii) a dry tensile strength of 310 to 410 cN/25 mm in a longitudinal direction, a dry tensile strength of 120 to 160 cN/25 mm in a lateral direction, and a wet tensile strength of 55 to 90 cN/25 mm in the lateral direction, all as measured in two ply; and (iv) compression energy WC of 5.0 to 6.5 gf·cm/cm$^2$ under a load of 50 g/cm$^2$ in a KES test method.

2. The two ply tissue paper according to claim 1, having a two ply elongation percentage of 13.2 to 17.9% in a longitudinal direction when the tissue paper is dry.

3. The two ply tissue paper according to claim 1, having recoverability RC of 45 to 50% under a load of 50 g/cm$^2$ in the KES test method.

* * * * *